US005648787A

United States Patent [19]

Ogot et al.

[11] Patent Number: 5,648,787

[45] Date of Patent: Jul. 15, 1997

[54] PENETRATING MICROWAVE RADAR GROUND PLANE ANTENNA

[75] Inventors: Rolando B. Ogot, San Diego; Mark Gaspar, Glendale, both of Calif.

[73] Assignee: Patriot Scientific Corporation, Poway, Calif.

[21] Appl. No.: 346,438

[22] Filed: Nov. 29, 1994

[51] Int. Cl.[6] ..... H01Q 21/00

[52] U.S. Cl. ..... 343/826; 343/829; 343/848

[58] Field of Search ..... 343/826, 827, 343/828, 829, 844, 853, 848, 846, 893

[56] References Cited

U.S. PATENT DOCUMENTS

| | | | |
|---|---|---|---|
| 2,424,968 | 8/1947 | Busignies | 343/826 |
| 2,611,871 | 9/1952 | Alford et al. | 343/826 |
| 3,534,378 | 10/1970 | Smith, Jr. | 343/828 |
| 4,649,396 | 3/1987 | Friedman | 343/705 |
| 4,658,266 | 4/1987 | Doty, Jr. | 343/829 |
| 4,724,443 | 2/1988 | Nysen | 343/700 MS |
| 4,843,402 | 6/1989 | Clement | 343/853 |
| 4,903,033 | 2/1990 | Tsao et al. | 343/700 MS |
| 5,068,671 | 11/1991 | Wicks et al. | 343/799 |
| 5,124,713 | 6/1992 | Mayes et al. | 343/700 MS |
| 5,157,393 | 10/1992 | Fox et al. | 343/763 |
| 5,264,862 | 11/1993 | Kumpfbeck | 343/853 |

FOREIGN PATENT DOCUMENTS

| | | | |
|---|---|---|---|
| 0063905 | 4/1982 | Japan | 343/827 |

OTHER PUBLICATIONS

The ARRL Antenna Book, pp. 2–40–2–41, and 8–1 8–5 date is not provided.

Antenna's, by Krauss, pp.140–145 date is not provided.

*Primary Examiner*—Donald T. Hajec

*Assistant Examiner*—Tan Ho

*Attorney, Agent, or Firm*—Thorpe North & Western, L.L.P.

[57] ABSTRACT

A penetrating microwave radar ground plane antenna system with separate arrays of transmission antenna elements and receiving antenna elements. The lengths of transmitting and receiving antenna elements are selected to enable the transmission of a nearly single-cycle pulse, the reduction of ringing between antenna elements, the reception of a signal significantly reduced in noise, and the penetration of materials having varying dielectric constants.

24 Claims, 8 Drawing Sheets

PENETRATING MICROWAVE RADAR GROUND PLANE ANTENNA

BACKGROUND OF THE INVENTION

1. Field of the Invention

This invention pertains to radio frequency (RF) antennae, and in particular to RF antennae adapted for short pulse signal transmission, where a first ground plane monopole antenna generates a short period pulse with minimal residual signal after application of transmission energy to the antenna has ceased, and where a second ground plane monopole antenna receives backscatter containing more useful information and less noise than penetrating radar systems in the prior art.

2. Prior Art

Since the discovery of radio frequency transmission, antenna design has been an integral part of many telemetry applications. Antenna applications became more diverse as the potential range of usable transmission frequencies increased, and antenna designs became more exotic. Of particular relevance to the present invention are the antennas operating in the microwave range of frequencies.

Antennas capable of transmitting microwaves have come in many shapes and designs as illustrated by U.S. Pat. Nos. 4,649,396, 4,903,033 and 5,068,671. Not only has each has been designed to operate in the microwave range, they were designed to overcome specific problems, such as transmitting in specific environments such as high winds, transmitting specific types of polarized signals, and transmitting broad-band signals having desirable phase and polarization characteristics respectively.

The variety of shapes and configurations of the antenna elements demonstrates that solutions to specific problems often require specific antenna geometries. For example, U.S. Pat. No. 4,649,396 discloses a monopole antenna mounted perpendicular to a ground plane. That particular antenna is known to those skilled in the art as a ground plane antenna. A ground plane antenna is a capacitive structure, unlike other antenna elements that characteristically have current flow. The specific structure can vary greatly, but must have two distinguishing elements. First, it must have a ground plane which is any surface or plane creating configuration that assists in establishing the radiation pattern of the antenna element, and second, it must have a radiating element that is typically a fraction of the wavelength to be transmitted. Geometries for a ground plane antenna are shaped to provide specific transmitting and receiving characteristics, limited only by the creativity of the designer.

When designing an antenna, a fundamental consideration is how that shape will vibrate. An antenna functions because of the principle of resonance. An antenna element resonates at the frequency applied by a transmission source connected to the element, or at the frequency of a received signal. While resonance of the antenna element is desired, uncontrolled resonance only serves to complicate certain applications of radio frequency technology, such as radar. The uncontrolled resonance being referred to is any resonance of the antenna element that occurs after a transmission signal is applied and subsequently terminated.

As might be expected, all the antennas cited in the U.S. patents above resonate for a relatively short period of time after transmission of an applied signal has stopped. It is important to note that the time frame being discussed is only a matter of nanoseconds, and is therefore usually inconsequential for most applications. However, when working with radar signals in the range of microwaves that must penetrate a mass of differing dielectric materials, nanoseconds are critical. The end result of using the antennas disclosed in the prior art is that their effective application for radar in a cluttered dielectric environment is considerably reduced.

The reduction in effectiveness of antenna elements because of resonance would seem to be inconsistent with an antennas' principle of operation. However, it is only because the frequency of operation of the present invention is in the range of microwaves that the dichotomy becomes apparent. The prior art antennas tested for use in the present invention characteristically produced a trailing resonance signal of mere nanoseconds of duration after the transmission source was eliminated. The problem arises because the duration of the signal transmitted is also in the range of nanoseconds. Thus, noise generated by the antenna itself is similar to the transmission signal being generated, making interpretation of backscatter more difficult and interfering with operation of the antenna as a penetrating radar.

A radar attempts to gather information from backscatter. Backscatter is the reflected signal bounced off objects of interest. When the signal transmitted is of a known amplitude, frequency and duration, it is easier to learn from backscatter, and to determine characteristics about the object reflecting the signal. In effect, it becomes easier to separate useful information from the noise. However, when the signal transmitted is followed by a trailing resonance signal as is typical in the prior art, backscatter might be a signal reflected from a waveform of unknown amplitude, frequency, or duration. Determining which backscatter signals contain useful information becomes complicated, and often sophisticated and costly equipment is required to analyze all of the backscatter to find the desired information.

Accordingly, the challenge in designing a microwave radar antenna is in overcoming trailing transmission resonance, producing a single cycle uniform output of known amplitude, frequency and duration, and receiving useful backscatter that is not affected by transmission resonance of the transmitted pulse.

OBJECTS AND SUMMARY OF THE INVENTION

It is an object of the present invention to provide an antenna capable of generating a single pulse signal without transmission of a trailing resonance signal.

It is a further object of this invention to provide a ground plane antenna for use as a penetrating microwave radar that avoids unnecessary reflected signals from transmitting antenna resonance transmissions.

A further object of this invention is to provide separate transmission and receiving antenna elements whose length ratio enables reception of a signal having reduced resonance noise that normally occurs between transmitting and receiving antennas.

Another object of the present invention is the development of an antenna useful for transmitting short pulse signals for data transmission through barriers that tend to reflect radio frequency transmissions.

An additional object of this invention is to arrange the transmitting elements in an array that is useful for directing the transmitted energy.

These and other objects are realized in an antenna device where ground plane antennas for transmitting a short pulse duration signal of a predetermined radio frequency are placed in a frame for directing transmitted energy, thereby forming a penetrating microwave radar. A separate frame of ground plane antennas is positioned to receive backscatter from transmitted signals. The lengths of transmitting and receiving antenna elements are selected to enable the transmission of a nearly single-cycle pulse, the reduction of ringing between antenna elements, the penetration of materials having varying dielectric constants, and the reception of a signal significantly reduced in noise. Transmission means are also provided for applying a short positive pulse to a transmitting antenna elements. Backscatter is received by the separate receiving ground plane antennas for sampling by a signal sampler. Output from the sampler is converted by an analog to digital (A/D) convertor to a digitized waveform. The digitized waveform is then analyzed by a signal processor and displayed.

Also disclosed is a method for choosing transmitting and receiving antenna element lengths such that ringing between antenna elements is reduced. This method includes the steps of: (i) selecting a transmitting antenna monopole element whose length is approximately one-quarter wavelength of the predetermined operating frequency, (ii) choosing a ground plane for the transmission antenna that is a circular disk with a diameter of approximately one-quarter wavelength of the predetermined operating frequency, (iii) transmitting a short pulse single-cycle RF signal, (iv) choosing a receiving antenna monopole element that is approximately twice the length of the transmitting antenna element, (v) choosing a ground plane for the receiving antenna that is a circular disk with a diameter of approximately one-quarter wavelength of the predetermined operating frequency, (vi) receiving, sampling and digitizing the analog backscatter signal, and (vii) displaying the digitized signal.

These and other objects and features of the present invention will be apparent to those skilled in the art based on the following detailed description taken in combination with the accompanying drawings.

DETAILED DESCRIPTION OF THE INVENTION

Figure 1:
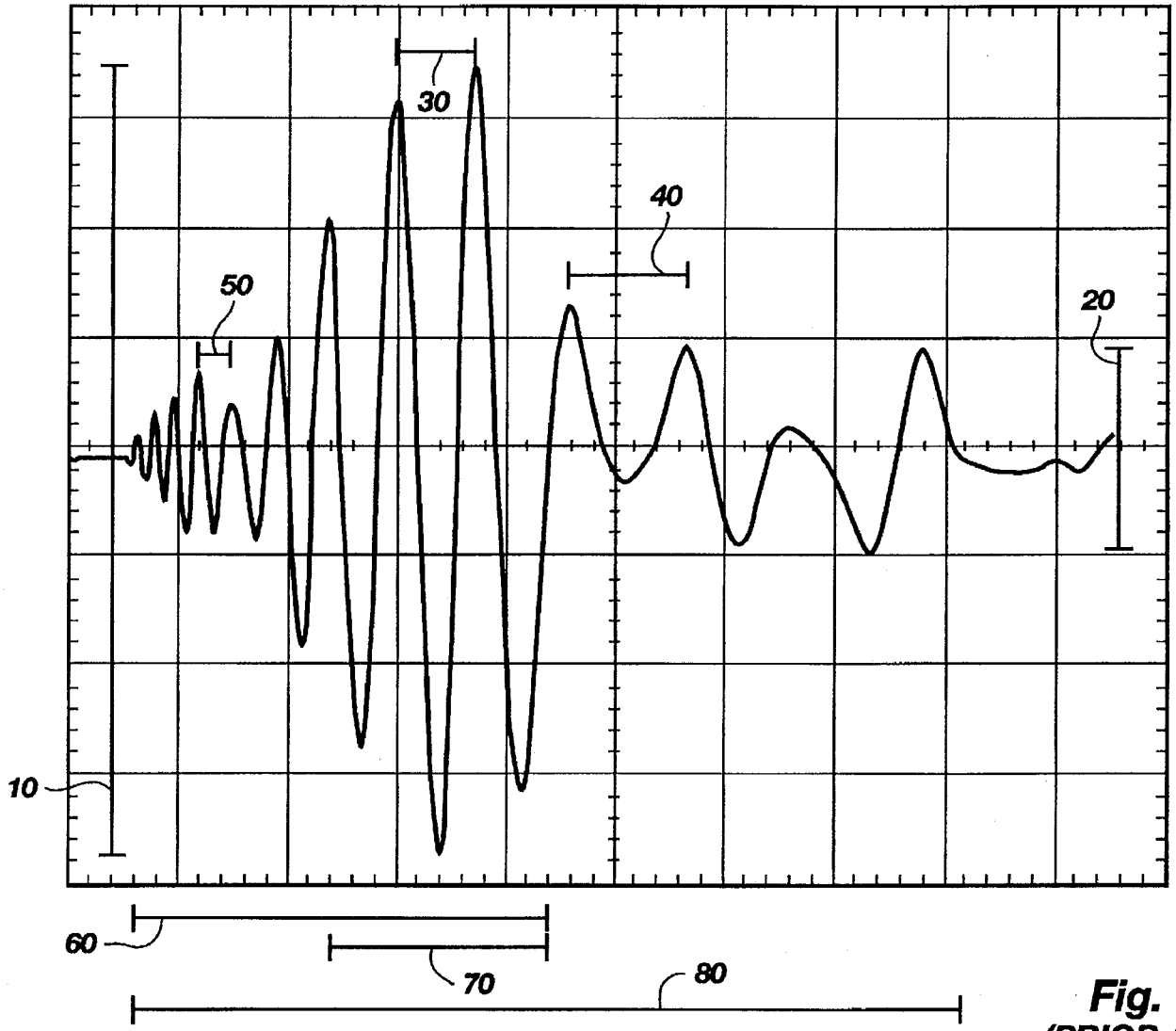
Fig. 1 (PRIOR ART)
FIG. 1 is a graphic illustration of a signal transmitted from a conventional antenna element such as a log-periodic antenna, including a residual signal resonating after termination of an RF signal source.

FIG. 1 shows an example of a radio frequency transmission from an antenna used in the prior art. The configuration of the transmission and reception antenna is known to those skilled in the art as a log-periodic antenna. As the graphed waveform illustrates, it is difficult to determine the amplitude, frequency, and duration of the signal that was actually applied to the antenna. This difficulty is not only the result of uncontrolled resonance of a trailing signal, but also the ramping up of the applied signal. Such a transmitted signal produces backscatter that requires sophisticated equipment to decipher which signals resulted from the known but noisy transmitted signal waveform.

For example, the amplitude of the signal could be indicated by measurement 10 or 20. The frequency could be indicated by measurements 30, 40, or 50. Likewise, the duration of the signal the antenna was supposed to transmit could be indicated by measurements 60, 70 or 80.

Figure 2:
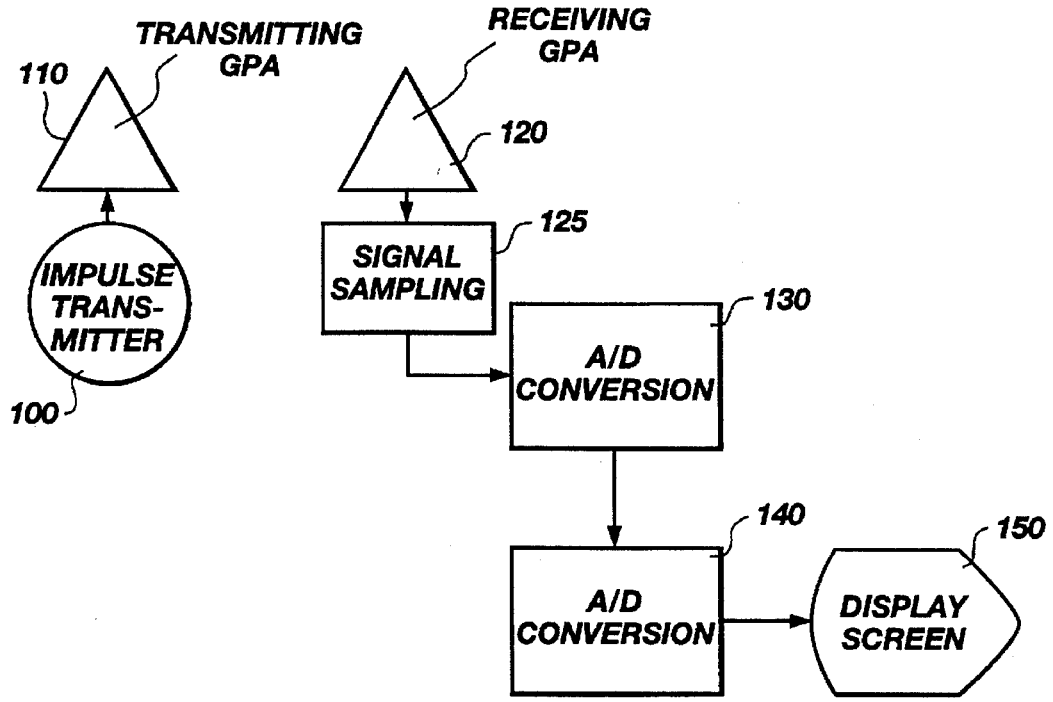
FIG. 2 shows a flowchart of the processes in an embodiment of the present invention as a penetrating microwave radar.
Figure 7:
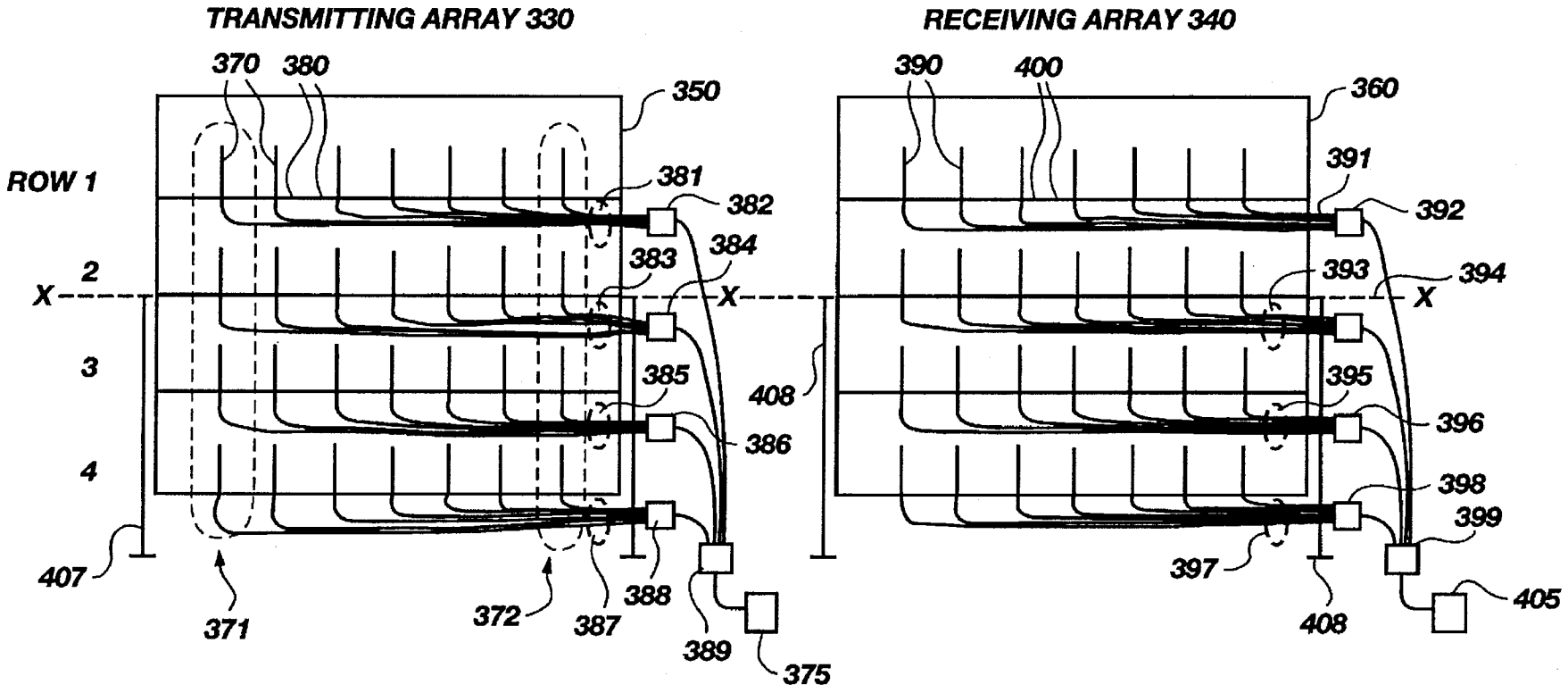
FIG. 7 is a plan view of transmitting and receiving ground plane antennas arranged in arrays in accordance with the present invention.

FIG. 2 illustrates in block diagram form the components of the present invention. The invention illustrated in FIG. 7 is a combination of the two ground plane antennas shown in FIGS. 2 and 3, but configured in arrays for transmitting and receiving. The arrays allow directing of the signal being transmitted. Ground plane antennas were used in the system to both transmit signals and receive the backscatter because of the unique characteristic to be disclosed about the combination.

As shown in FIG. 2, an impulse transmitter 100 generates a signal for transmission by the transmitting ground plane antenna (GPA) 110. In this embodiment, the duration of the signal transmitted is a 2 nanosecond positive pulse with an amplitude of 100 volts. When a reflected signal returns, the receiving GPA 120 resonates, generating an electrical signal that is sent to a signal sampler 125. In the present embodiment, a LeCroy signal sampler provides the sampling before the signal is further processed. The sampler provides an analog signal that is sent to an analog to digital (A/D) convertor 130. The digital output of the A/D convertor 130 is sent to a signal processor 140 to extract desired information. Once noise has been eliminated and useful backscatter extracted from the digital signal, the signal is shown on a display screen 150.

While any antenna could be used with the processes disclosed, the present invention teaches unique properties of the ground plane antennas that the inventors have not found in the prior art. These properties discussed in FIG. 3 enable generation of a signal free from trailing resonance, and reception of backscatter that does not interfere with the transmitting antenna.

Figure 3A:
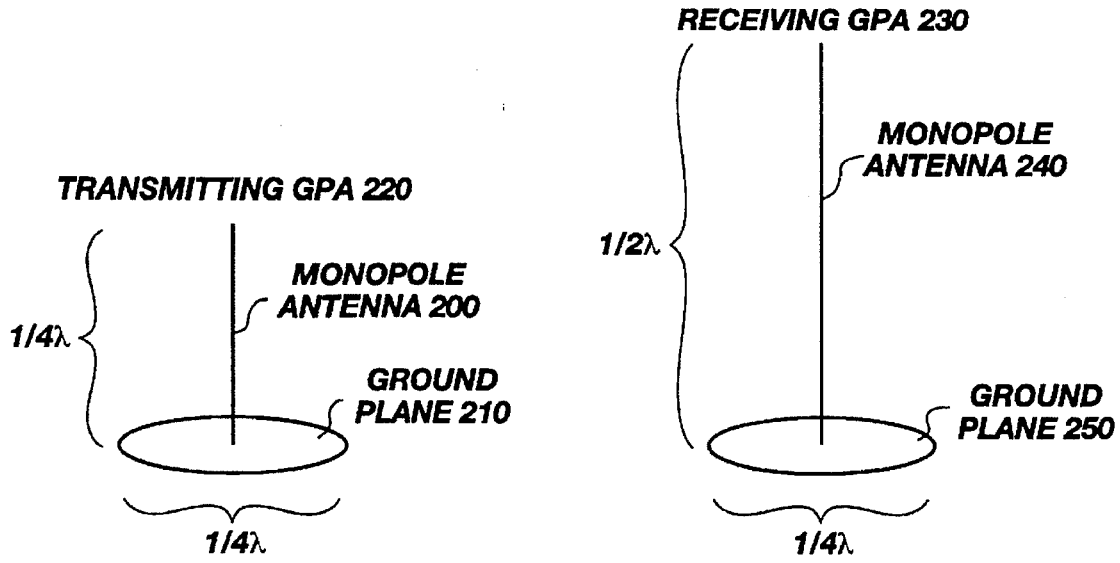
FIG. 3A is a perspective view of the shape of the transmitting and receiving antennas and ground planes.

As FIG. 3A illustrates, the antenna system of the present invention uses both transmitting and receiving ground plane antennas (GPAs). The transmitting GPA 220 uses a monopole antenna 200 as the transmission element. The length of the element is preferably one-quarter wavelength of the predetermined frequency to be transmitted. The one-quarter wavelength element length is used because of the power transfer efficiency characteristics as is known to those skilled in the art. The transmission element extends perpendicularly from the center of a ground plane element 210.

The ground plane element 210 of the transmission antenna 220 assists in creating the radiation pattern. Shown here, the transmission ground plane 210 is a circular disk. The diameter of the disk is not critical if near one-quarter wavelength of the predetermined frequency to be transmitted. However, if less than one-eighth wavelength, the signal quality begins to degrade. The ground plane could certainly be larger, but for efficient packaging of the system, a one-quarter wavelength diameter is adequate. The shape of the ground plane is also not absolutely critical. A flat and circular disk shape maximizes the surface area of the ground plane perpendicular to the transmission element, and provides a uniform transmission pattern.

The receiving GPA 230 is slightly different in configuration from the transmitting GPA 220. Most importantly, the receiving monopole antenna element 240 length is preferably one-half wavelength of the predetermined frequency to be transmitted in the present embodiment. More generically and accurately stated, the receiving element 240 length is preferably twice the transmission element 200 length.

Finally, the ground plane element 250 of the receiving antenna 230 shown here is also in the shape of a circular disk. The diameter of the ground plane is also one-quarter wavelength of a predetermined frequency to be transmitted. As disclosed earlier, as long as the diameter is greater than one-eighth wavelength of a predetermined transmission frequency, the signal will not be degraded by the ground plane. It was decided specifically to use one-quarter wavelength for the receiving ground plane antennas so that the packaging of the transmission antenna array and the receiving antenna array shown in FIG. 7 would be similar.

Figure 4:
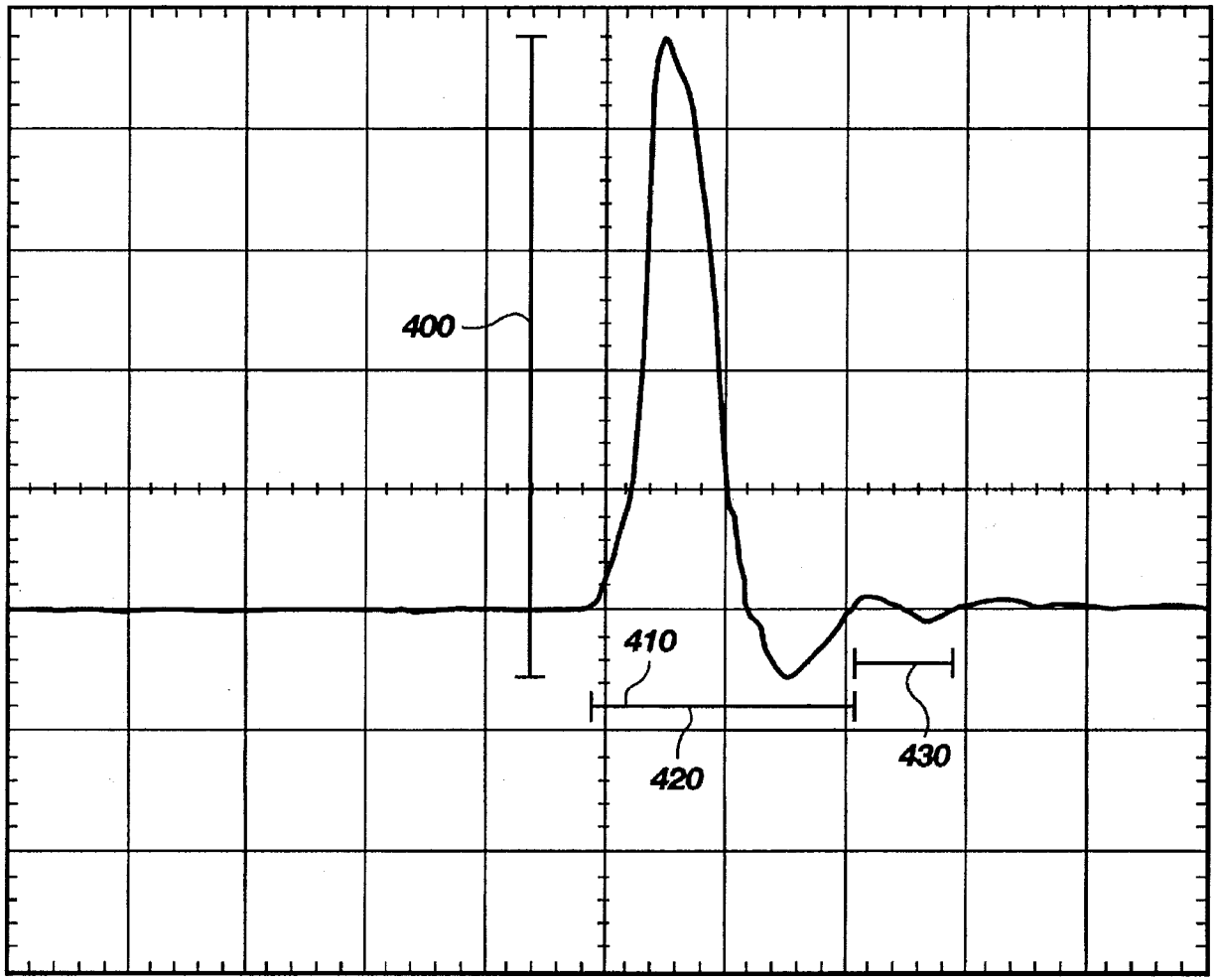
FIG. 4 is a graphic illustration of a short pulse RF signal transmitted in accordance with the present invention.

The reason for having different transmitting 200 and receiving 240 monopole antenna element lengths is that the inventors apparently discovered that different lengths reduce the ringing (undesired resonance) between the antennas. In radar applications, ringing creates noise that interferes with the receiving antenna. Most importantly, the signal produced by the transmitting antenna 200 element is thereby reduced to nearly a single cycle as shown in FIG. 4. It is much easier to determine the amplitude 400, frequency 410 and duration 420 of the transmitted signal because there is almost no trailing resonance signal 430 (reduced in duration and amplitude) as compared to FIG. 1.

Figure 3B:
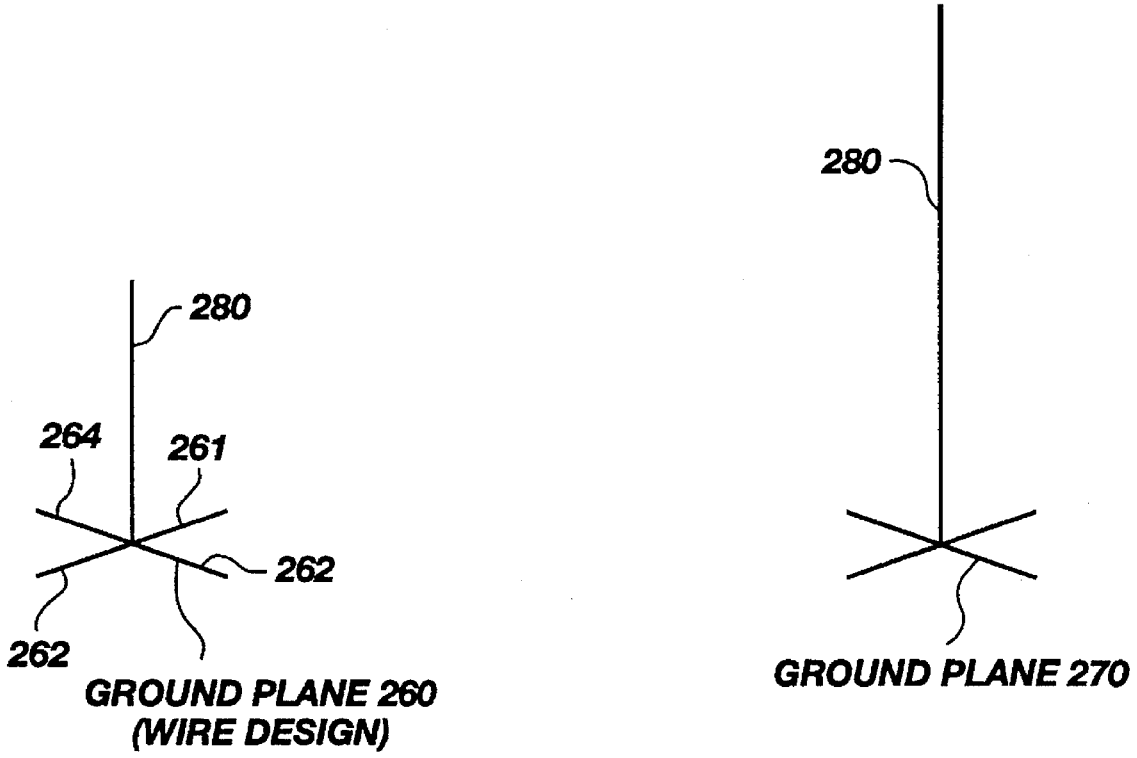
FIG. 3B is a perspective view of an alternative shape of a ground plane that is equally applicable to the implementation of the present invention.

FIG. 3B shows an alternative embodiment of a ground plane antenna. Instead of a flat disk, the ground plane 260 consists of four wires 261, 262, 263 and 264 that extend outward in a plane like spokes of a wheel. At the point where the wires intersect, the antenna element extends perpendicularly. This design enables a much lighter ground plane antenna which is just as effective in creating a ground plane as the flat disks 210 and 250 of FIG. 3A.

Figure 5:
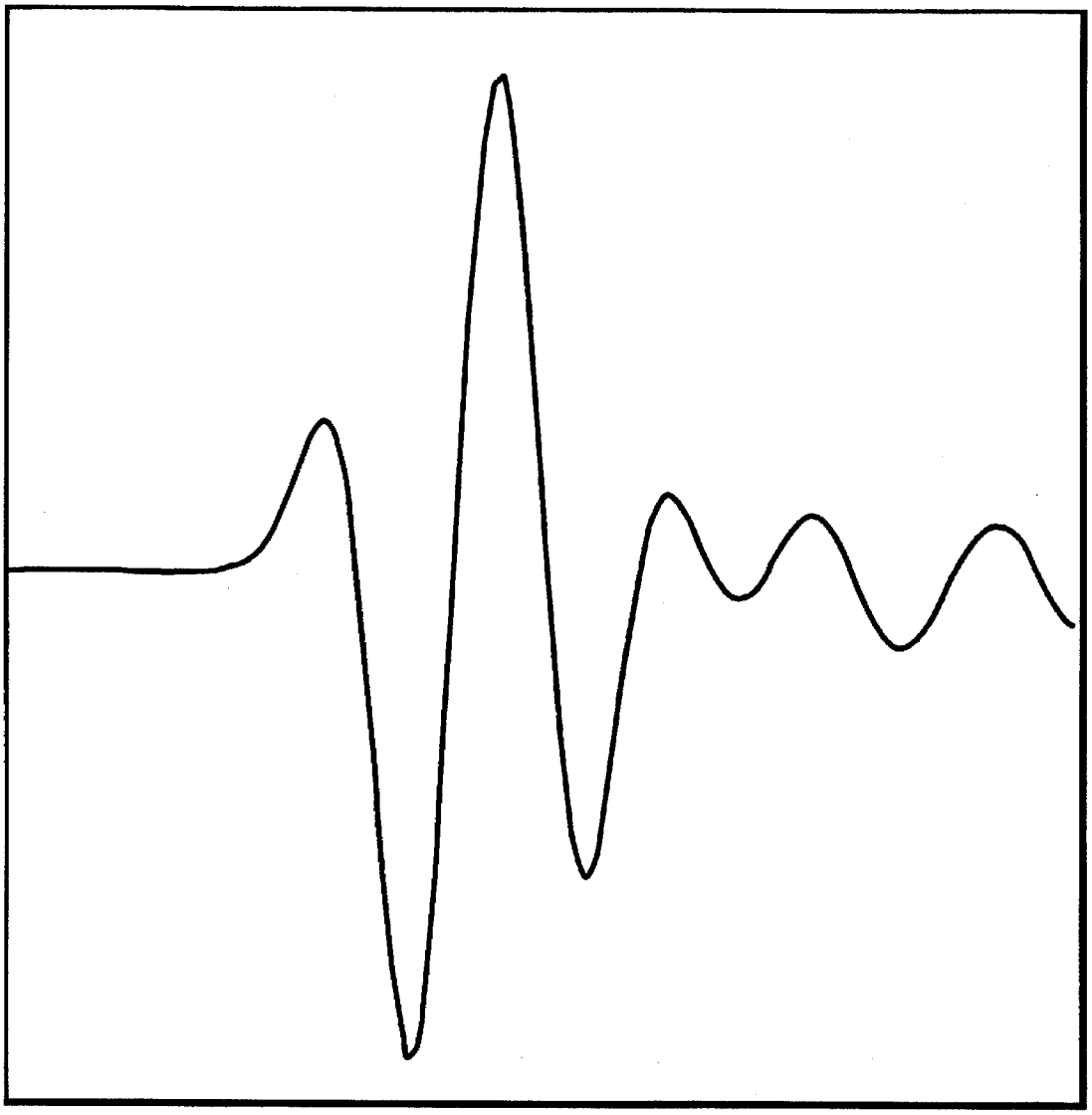
FIG. 5 is a graphic illustration of a received RF signal in accordance with the present invention.

The signal received by the receiving GPA is graphed in FIG. 5. The signal is virtually free from noise, and indicates a readily distinguishable waveform. These results differ from the received waveform of a one-quarter transmit and one-quarter reception antenna system as discovered by the inventors. Ringing between like-sized antennas, or the same antenna being used to transmit and receive, results in a much noisier signal that makes it difficult to discern desired backscatter from extraneous signals.

Figure 6:
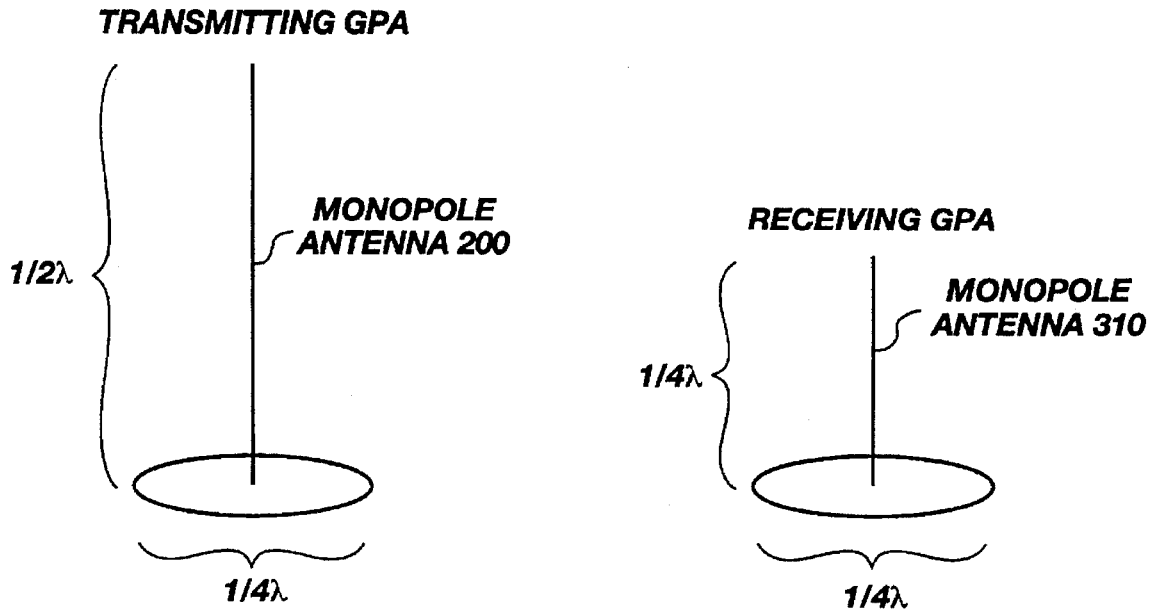
FIG. 6 is a perspective view of an alternate embodiment of the present invention with the ratio of the length of monopole antenna elements reversed.

FIG. 6 shows an alternative embodiment of the present invention. The main feature that makes this figure different from FIG. 3 is that the lengths of the antenna elements have been reversed. In other words, the transmission antenna element 300 is now one-half wavelength of the predetermined frequency to be transmitted, and the receiving antenna element 310 is one-quarter wavelength. This figure is included to show that while it is not as efficient in terms of power transfer to have a transmission antenna element that is not a length of one-quarter wavelength, it is still possible for the radar to have the same desirable characteristics.

The present invention teaches the apparently new concept that it is the relationship in antenna element lengths that is critical for reduced noise in transmission and reception, one being of length n, the other of length 2n. For power transfer efficiency, the present invention equates the length n to be one-quarter wavelength of the transmission frequency, and thus the other length 2n to be one-half wavelength of the same transmitted frequency. It is this configuration of monopole antenna element lengths in a capacitive structure of a ground plane antenna that results in a cleaner transmitted waveform of known amplitude, frequency and duration.

FIG. 7 illustrates a full-scale embodiment of the present invention. An array or line of transmitting or receiving ground plane antennas are set in frames 350 and 360. The array frame enables a transmitted signal to be directed from a face or an edge of the array, as the operator desires. To transmit from a face (shown) requires that all antennas transmit simultaneously. This configuration is known to those skilled in the art as a broadside array, and results in energy being transmitted bi-directionally from the front and rear of the array face.

An alternate transmission embodiment would be a configuration known to those skilled in the art as an end-fire array. The same physical array frame is used, but antenna transmission timing changes. Transmission begins from one edge of the array, for example the antennas in the column defined as 371, and continues in sequence down the line of antennas in the array to the opposite edge of the array shown as column 372. After the first antenna element transmits, successive antenna element transmissions are timed to occur when the transmitted signal wavefront reaches the element that has not yet transmitted. The result is a uni-directional signal that is directed along the array face to the left or right array edge, depending upon the timing chosen.

The transmission frame 350 is shown from a face perspective with four rows of GPAs. For illustrative purposes only, the frame is shown with seven ground planes 380 and seven monopole antenna elements 370 on each row. Each monopole antenna element 380 is also connected to an RF transmission source 375. In either the broadside or end-fire array transmission configuration, wiring of antenna elements is done to achieve careful control of the phase of the signals transmitted. This is accomplished by connecting each antenna element 370 to a same length wire that reaches the transmission source 375. The same length wire bundles 381, 383, 385 and 387 connect to 7-to-1 connector boxes, 382, 384, 386 and 388. These boxes are connected by same length wires to a 4-to-1 connector box 389 that distributes signals from the transmission source 375. The result of using same length wiring is that the timing of transmissions is precisely controlled. A transmission to all antennas simultaneously results in a broadside transmission. A transmission to antenna elements 370 defined by column 371 sequentially to consecutive antenna elements 370 down to column 372 will result in an end-fire transmission from the right array edge of the frame 350.

The receiving antenna array frame 360 is likewise shown in a face perspective, and is always positioned so that backscatter is received by a face. The receiving frame 360, for illustrative purposes only, is also shown with four rows of GPAs, seven ground planes 400 and seven monopole antenna elements 390 on each row. Each monopole antenna element 390 is also connected to an RF reception device 405 by a similar arrangement of same length wire bundles 391, 393, 395 and 397 to 7-to-1 connector boxes 392, 394, 396 and 398, that in turn connect by same length wires to a 4-to-1 connector box 399, which connects to the signal reception device 405. The spacing between antennas is done in a typical manner as is known to those skilled in the art.

The frames 350 and 360 are rotatable to facilitate directing the transmission of the radar pulse, and for receiving the backscatter. The frames rotate about an axis parallel to the length of the horizontal rows of the frames, generally at a midpoint of a vertical edge so that rotating the frames occurs at a center of gravity, and thus does not cause them to tip over. Each frame is held by supports, shown here as 407 for frame 350, and 408 for frame 360.

Figure 8A:
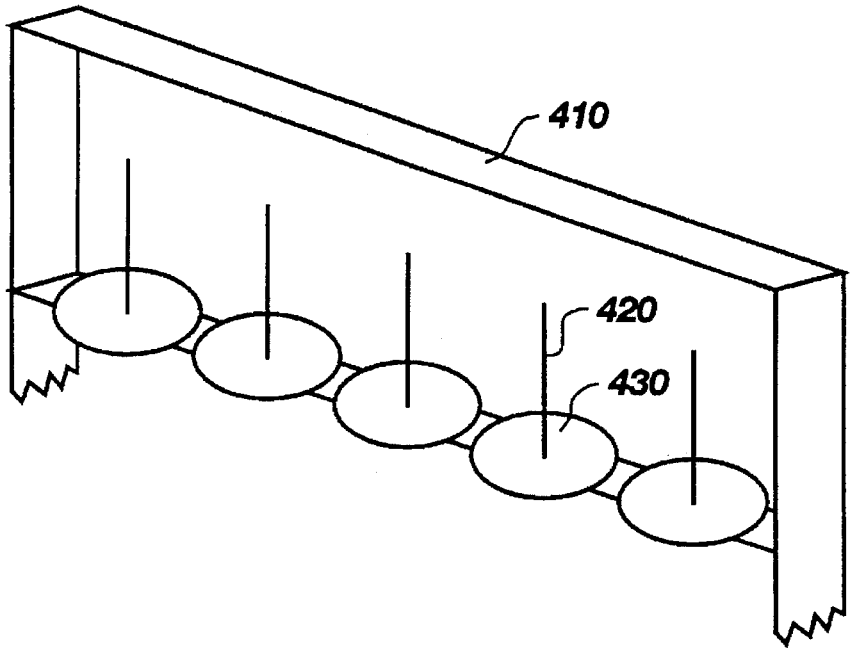
FIG. 8A is a perspective view of an antenna array in accordance with the present invention.

FIG. 8A is a perspective view of a single row of GPAs, transmitting or receiving, set within a frame 410. The GPAs each consist of a monopole antenna element 420, and circular disk 430 as the ground plane.

Figure 8B:
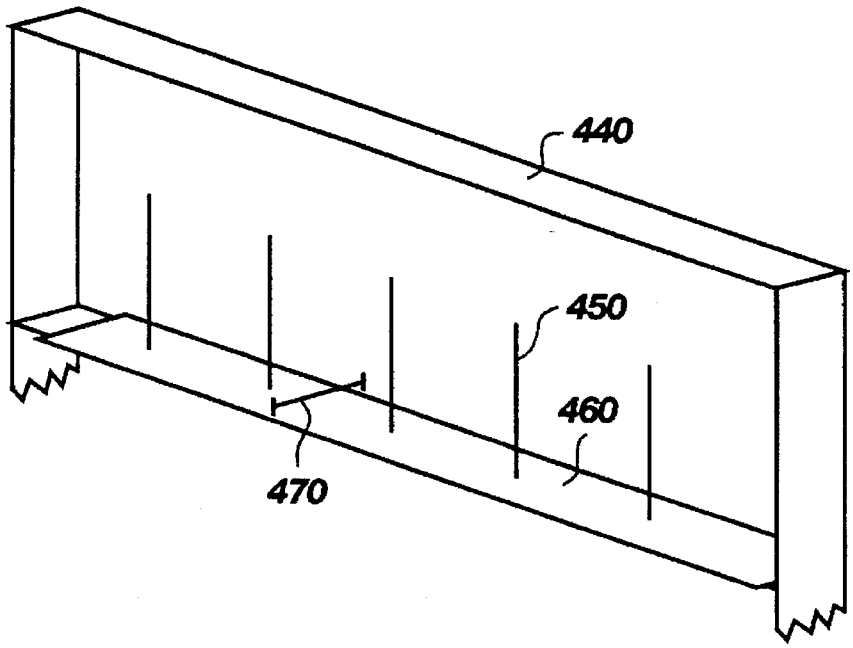
FIG. 8B is a perspective view of an alternative embodiment of the antenna array.

FIG. 8B is an alternative embodiment that shows the versatility that the shape of the ground plane can have in the present invention. Instead of circular disks or wires, the ground plane on the frame 440 is a solid electrically conductive sheet 460 in a rectangular shape. The antenna elements 450 rise perpendicularly from the ground plane 460. The width 470 of the ground plane 460 should be at least one quarter wavelength of the predetermined frequency to be transmitted or received to avoid signal degradation.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. An antenna system having a first ground plane antenna for transmitting short pulse duration radar signals of a predetermined radio frequency, and a second ground plane antenna positioned so as to receive backscatter from a transmitted signal of the first ground plane antenna, wherein the system is designed to reduce a trailing resonance signal from the first ground plane antenna, said device comprising:

a first ground means for establishing a ground plane for the first ground plane antenna;

a first transmitting antenna element extending substantially orthogonally from the ground plane of the first ground means, the first transmitting antenna element having an approximate length which is unequal to and a multiple of an associated first receiving antenna element to thereby reduce a trailing resonance signal from the first transmitting antenna element;

a radio frequency signal transmission means coupled to the first transmitting antenna element for applying a signal thereto;

a second ground means for establishing a ground plane for the second ground plane antenna;

the associated first receiving antenna element extending substantially orthogonally from the ground plane of the second ground means, the associated first receiving antenna element having an approximate length which is unequal to and a multiple of the first transmitting antenna element to thereby reduce the trailing resonance signal therefrom;

a signal processing means coupled to the first receiving antenna element for processing signals received therefrom; and orienting means for positioning the first transmitting antenna to direct the transmitted signal at a predetermined location, and for positioning the first receiving antenna to receive backscatter from the predetermined location.

2. The antenna device as defined in claim 1, wherein the first transmitting antenna element is a monopole antenna whose length is approximately one-quarter wavelength of a predetermined radio frequency to be transmitted, and the first receiving antenna element is a monopole antenna whose length is approximately twice the length of the first transmitting antenna element.

3. The antenna device as defined in claim 1, wherein the first transmitting antenna element is a monopole antenna whose length is approximately one-half wavelength of a predetermined radio frequency to be transmitted, and the first receiving antenna element is a monopole antenna whose length is approximately one half the length of the first transmitting antenna element.

4. The antenna device as defined in claim 1, wherein the first ground means further comprises an electrically conductive disk having a flat top face and a bottom face, a thin side edge, and a diameter of at least one-quarter wavelength of a predetermined radio frequency to be transmitted.

5. The antenna device as defined in claim 1, wherein the second ground means further comprises an electrically conductive disk having a flat top face and a bottom face, a thin side edge, and a diameter of at least one-quarter wavelength of a predetermined radio frequency to be transmitted.

6. The antenna device as defined in claim 1, wherein the first ground means is a plurality of straight wires that radiate from a central point, and define a plane.

7. The antenna device as defined in claim 6, wherein the plurality of straight wires comprises a set of four wires of equal length, where the length is at least one-quarter wavelength of the predetermined frequency to be transmitted, and each wire radiates from the central point at a right angle to adjacent wires, and parallel to but extending in an opposite direction from a nonadjacent wire.

8. The antenna device as defined in claim 1, wherein the radio frequency signal transmission means further comprises an impulse transmitter.

9. The antenna device as defined in claim 8, wherein the impulse transmitter generates radio frequency signals in the range of microwaves.

10. The antenna device as defined in claim 1, wherein the signal processing means further comprises:

an analog signal sampling device that receives a signal and samples backscatter in the signal to produce an analog signal output which is coupled to an analog to digital converter;

an analog to digital converter that receives said analog signal and converts said analog signal output into digital data which is sent to a signal processor; and a signal processor device that receives said digital data and extracts useful data from noise.

11. The antenna device as defined in claim 1, wherein the device further comprises a plurality of ground plane antennas disposed on a frame, said frame having a plurality of parallel rows of support members, said rows of support members being held rigidly by the frame, the frame being rotatable along an axis parallel to the length of the rows and at an approximate center of mass of the frame, such that the frame can tilt forwards or backwards to a horizontal position, and the spacing between rows being sufficiently large so as not to physically interfere with the operation of ground plane antennas disposed thereon.

12. The antenna device as defined in claim 11, wherein the plurality of ground plane antennas disposed on each of the rows of support members are held by the frame and arranged such that the ground plane antennas are rigidly attached in parallel orientation defining a plane along each row of support members, said plurality of ground plane antennas being spaced apart a distance such that the ground plane antennas are not in contact.

13. The antenna device as defined in claim 12, wherein the device further comprises:

a first frame with a plurality of transmitting ground plane antennas disposed thereon for transmitting a penetrating microwave radar signal; and a second frame with a plurality of receiving ground plane antennas disposed thereon for receiving backscatter from the transmitted signal.

14. The antenna device as defined in claim 13, wherein a ground plane means of the plurality of transmitting and receiving ground plane antennas which are disposed on each row of support members further comprises an electrically conductive rectangular plane on each row, thereby defining a ground plane on each row of support members, wherein the width of the rectangular plane is at least one quarter wavelength of the predetermined frequency to be transmitted.

15. The antenna device as defined in claim 1, wherein the approximate length of the associated first receiving antenna element is one fourth that of the first transmitting antenna element.

16. The antenna device as defined in claim 1, wherein the approximate length of the associated first receiving antenna element is one eighth that of the first transmitting antenna element.

17. A method for producing antenna arrays that can be used as a penetrating microwave radar having reduced trailing resonance signals transmitted therefrom, the method comprising the steps of:

a) selecting a transmitting monopole antenna element whose length is approximately a multiple of a receiving antenna element length to thereby reduce a trailing resonance signal from the transmitting antenna element;

b) selecting an electrically conductive ground plane for the transmission antenna and coupling the ground plane thereto;

c) positioning the transmitting monopole antenna element to direct the transmitted signal at a predetermined location;

d) transmitting a short pulse radio frequency signal from the transmitting monopole antenna element at the predetermined location;

e) selecting a receiving monopole antenna element whose length is approximately a multiple of the transmitting antenna element length to thereby reduce the trailing resonance signal from the transmitting antenna element;

f) selecting an electrically conductive ground plane for the receiving antenna and coupling the ground plane thereto; and g) positioning the receiving monopole antenna element to receive backscatter from the predetermined location.

18. The method as defined in claim 17, wherein step a) further comprises selecting the transmission antenna element length to be at least one-quarter wavelength of a predetermined radio frequency to be transmitted.

19. The method as defined in claim 17, wherein step b) comprises selecting the transmission ground plane from the group consisting of a flat disk of diameter n, a plurality of equal length wires of length ½n extending from a central point to form a plane of equally spaced wires, and a rectangular sheet of width n.

20. The method as defined in claim 19, wherein n is defined to be at least one-half wavelength of a predetermined radio frequency to be transmitted.

21. The method as defined in claim 17, wherein step e) more specifically comprises selecting the receiving antenna element length to be at least one-half wavelength of a predetermined radio frequency to be transmitted.

22. The method as defined in claim 17, wherein step f) more specifically comprises selecting the receiving ground plane from the group consisting of a flat disk of diameter n, a plurality of equal length wires of length ½n extending from a central point to form a plane of equally spaced wires, and a rectangular sheet of width n.

23. The method as defined in claim 22, wherein n is defined to be at least one-half wavelength of a predetermined radio frequency to be transmitted.

24. The method as defined in claim 17, wherein the method includes the ability to obtain an improved reflected image at the receiving monopole antenna element, wherein less noise clutters a radar image generated from the backscatter.

* * * * *